US007793704B2

(12) United States Patent
Maeyama et al.

(10) Patent No.: US 7,793,704 B2
(45) Date of Patent: Sep. 14, 2010

(54) METHOD OF INSTALLING SAND CORE FOR CASTING IN MOLD AND SAND CORE FOR CASTING

(75) Inventors: Kenichi Maeyama, Tokyo (JP); Kazuhiro Yokoyama, Tokyo (JP); Masuyuki Ikeguchi, Tokyo (JP); Kazuki Miyazaki, Tokyo (JP)

(73) Assignee: Honda Motor Co., Ltd., Tokyo (JP)

( * ) Notice: Subject to any disclaimer, the term of this patent is extended or adjusted under 35 U.S.C. 154(b) by 446 days.

(21) Appl. No.: 11/887,351

(22) PCT Filed: Mar. 3, 2006

(86) PCT No.: PCT/JP2006/304082

§ 371 (c)(1),
(2), (4) Date: Sep. 28, 2007

(87) PCT Pub. No.: WO2006/112171

PCT Pub. Date: Oct. 26, 2006

(65) Prior Publication Data

US 2009/0139680 A1 Jun. 4, 2009

(30) Foreign Application Priority Data

Mar. 30, 2005 (JP) ..... 2005-097712

(51) Int. Cl.
*B22D 33/04* (2006.01)

(52) U.S. Cl. ..... 164/137; 164/302; 164/340; 164/369

(58) Field of Classification Search ..... 164/28–32, 164/137, 302, 340, 369, 397–399
See application file for complete search history.

(56) References Cited

U.S. PATENT DOCUMENTS

| | | | | |
|---|---|---|---|---|
| 5,720,334 | A * | 2/1998 | Usui et al. | 164/340 |
| 6,422,294 | B1 | 7/2002 | Murata et al. | |
| 7,096,920 | B2 * | 8/2006 | Debus et al. | 164/98 |

FOREIGN PATENT DOCUMENTS

| | | | |
|---|---|---|---|
| DE | 600 22 602 | T2 | 7/2006 |
| EP | 1098726 | A1 | 5/2001 |
| JP | 63-2197 | | 1/1988 |
| JP | 4-129550 | | 11/1992 |
| JP | 2000-312961 | A | 11/2000 |
| JP | 33 20912 | | 6/2002 |
| WO | WO-00/66296 | A1 | 11/2000 |

* cited by examiner

*Primary Examiner*—Kuang Lin
(74) *Attorney, Agent, or Firm*—Birch, Stewart, Kolasch & Birch, LLP

(57) ABSTRACT

An upper surface of a skirting base section **6*h* of a sand core 6 is provided with a projection 14 of a column shape. When a slide mold 3 is slidingly moved in a mold clamping direction, a sliding contact section 15 of a holding recessed section 13 of the slide mold 3 is brought into sliding contact with the projection 14 to hold the projection 14 while scraping away part of the sand of the projection 14. The upper surface of the skirting base section 6*h* adjacent to the projection 14 is also provided with a recess 16 for recovering the scraped sand, wherein the width of the recess 16 is larger than the diameter of the projection 14 in the longitudinal direction. The projection 14** can be formed in a prismatic or semispherical shape.

9 Claims, 3 Drawing Sheets

Upper surface of inlet port

Upper surface of exhaust port

METHOD OF INSTALLING SAND CORE FOR CASTING IN MOLD AND SAND CORE FOR CASTING

BACKGROUND OF THE INVENTION

1. Field of the Invention

The present invention relates to a technique whereby, when a sand core for casting is installed in a mold, problems such as displacement of the sand core within the mold, an unnecessary clearance gap formed between the sand core and the mold, and possible damage of the sand core itself can be prevented for stable installation.

2. Description of the Prior Art

According to a conventional technology, a sand core for casting is generally installed in a mold by fitting a fitting section, such as a concavity and a convexity provided on a skirting base section of the sand core in a place other than a product section, into another fitting section such as a concavity and a convexity of the mold. In the case where the fitting sections such as a concavity and a convexity are provided in two remote locations, if the clearance between the fitting sections is small, there is some possibility that the core will be damaged because excessive force is applied to the core when the mold is deformed by thermal expansion. On the other hand, if the clearance is large, there is a problem in that the shape of the product is adversely affected because, when molten metal flows into a cavity, the core floats up, the molten metal gets into a gap formed by the floating core, or the core is displaced to cause a nonuniform phenomenon. To solve such a problem, a technique is known whereby a projected rim of an inverted V-shaped cross section is provided at a contact section between the skirting base section and the mold and when the mold sections are closed to hold the skirting base section therebetween, the projected rim is deformed to absorb the dimensional error (for example, refer to Patent Document 1).

On the other hand, a technique, whereby a dust storage groove is provided in a recess of the mold to prevent the dust within the recess from forcibly entering the cavity, is also known (for example, refer to Patent Documents 2 and 3).

Patent Document 1: Japanese Patent No. 3320912

Patent Document 2: Japanese Utility Model Publication No, Sho 63-2197

Patent Document 3: Japanese Unexamined Utility Model Publication No. Hei 4-129550

However, in such a technique as disclosed in Patent Document 1, there is a problem in that, when the projected rim is deformed to absorb the dimensional error, if the sand from the deformed place drops, the sand forcibly enters the cavity to cause the quality of a molded product to deteriorate. There is also a problem in that, since the skirting base section is held by surrounding its periphery by the upper mold, in the case where a pressing force is applied to the projected rim to push it onto the skirting base section side, the skirting base section is damaged if it is thin.

Further, in the techniques as disclosed in Patent Documents 2 and 3, there is a problem in that the mold structure becomes complicated and fabrication costs of the mold become high because the mold must be provided with the dust storage groove, and an operation is troublesome because the sand and the like must be regularly removed from the dust storage groove of the mold.

SUMMARY OF THE INVENTION

It is therefore an object of the present invention to provide an improved technique whereby a sand core can be prevented from being damaged, cracked or displaced even if a mold is deformed by thermal expansion when the core is installed in the mold, and an existing mold can still be used as is.

In order to attain this object, according to the present invention, a method for installing a sand core in a mold in which a slide mold slidably mounted on a lower mold is provided with a holding recessed section for holding a skirting base section of the sand core is provided, which comprises the steps of: causing the slid mold to advance in a condition in which part of a core body is positioned and mounted on the lower mold; bringing the lower surface of the holding recessed section of the slide mold into sliding contact with a projection provided on the upper surface of the skirting base section; clamping the mold while recovering the sand scraped from the projection through the sliding contact within a recess formed in a position of the upper surface of the skirting base section adjacent to the projection, thereby installing the sand core in the mold.

In this manner, by providing the projection on the upper surface of the skirting base section and bringing the lower surface of the holding recessed section of the slide mold into sliding contact with the projection, the skirting base section can be firmly held in position to prevent the core from being displaced. Further, even if the slide mold is deformed a little by thermal expansion, it can be absorbed by the deformation of the projection and as a result, excessive force is not applied to the core body. Still further, even if the sand of the projection is scraped away during the first set-up procedure or in the preceding deformation of the slide mold, there is no problem in which the scraped sand forcibly enters a cavity because the sand is recovered within the recess formed on the upper surface of the skirting base section.

Further, since the recess is formed in the sand core, the scraped sand is also recovered with the sand core when a molded product is pulled out and thus, no fragments are left in the mold.

By providing the upper surface of the skirting base section with the projection which is brought into sliding contact with the slide mold, it is possible for the pressing force not to act on the skirting base section itself even if the slide mold is deformed by thermal expansion, and as a result, it is possible to prevent the core from being damaged.

According to the present invention, a sliding contact section is formed to project downwards from the lower surface of the holding recessed section of the slide mold to be brought into sliding contact with the projection.

Such a sliding contact section readily causes friction because it positively scrapes the projection at the time of mold clamping. However, it is possible to cope with the friction by protrusively forming the sliding contact section as described above, for example, by readily building up the sliding contact section by means of welding.

According to the present invention, a sand core for casting having a core body mounted on a lower mold and a skirting base section held by a holding recessed section of a slide mold is provided, in which the upper surface of the skirting base section is provided with a projection which can be brought into sliding contact with the lower surface of the holding recessed section of the slide mold when the slide mold is clamped, and the upper surface of the skirting base section adjacent to the projection is provided with a recess for recovering the sand scraped from the projection.

If a plurality of projections and recesses is provided along the longitudinal direction of the skirting base section, the installation condition of the core can be made more stable.

If the projection is formed in a columned, prismatic or semispherical shape, it can not only be readily made, but can also be a partially smaller shape than the strip-shaped projection, and as a result, the recess adjacent to the projection can be easily formed. Further, if the width of the recess is made larger than the maximum width of the projection, the sand scraped from the projection can be completely and suitably recovered within the recess.

BRIEF DESCRIPTION OF THE DRAWINGS

The above and other objects, features and advantages of the present invention will become more apparent from the following description when taken in conjunction with the accompanying drawings.

DETAILED DESCRIPTION OF THE PREFERRED EMBODIMENTS

A preferred embodiment of the present invention will now be described with reference to the accompanying drawings.

Figure 1:
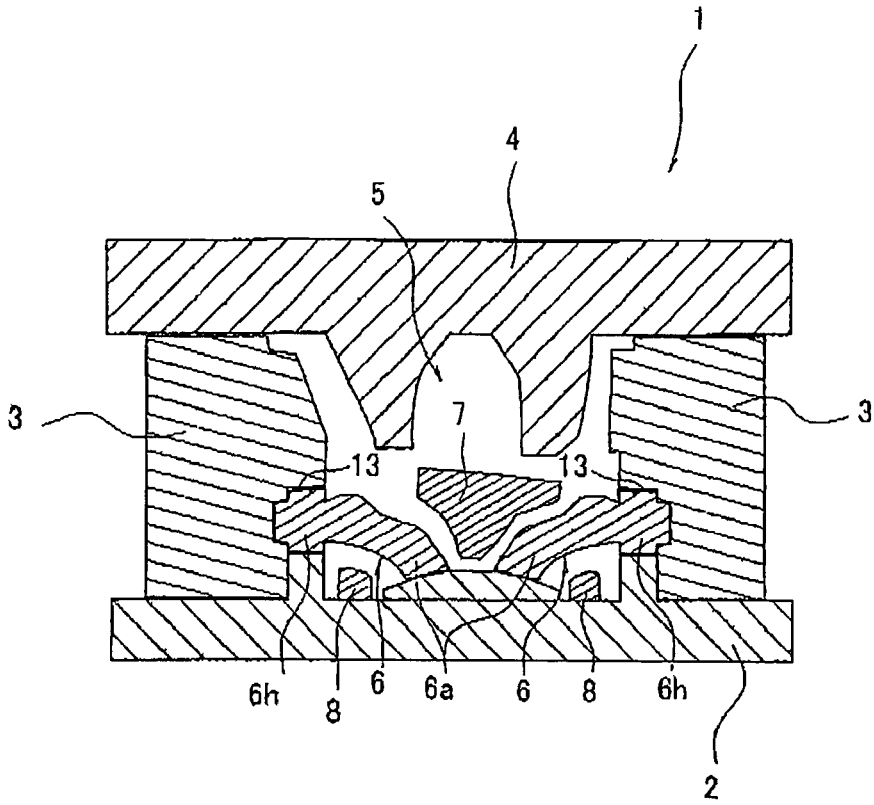
FIG. 1 is an explanatory view of an entire mold for casting a cylinder head to which a sand core for casting is applied.
Figure 2:
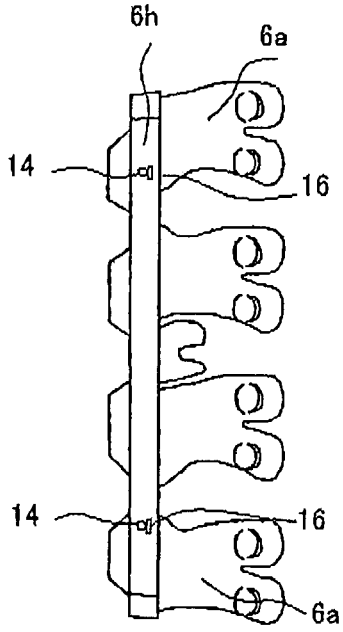
FIG. 2 is an explanatory view showing the upper surface of the sand core for casting.
Figure 2:
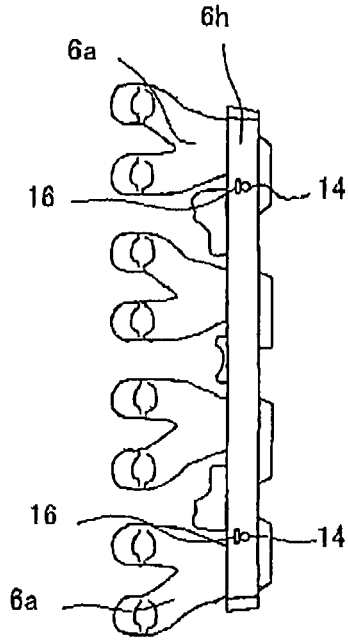
Figure 3:
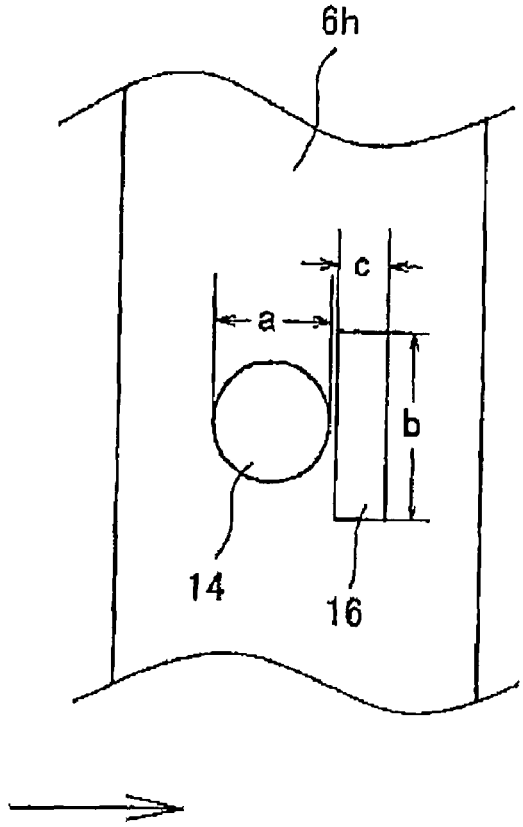
FIG. 3 is an enlarged view of a projection and a recess provided on the upper surface of a skirting base section.
Figure 4:
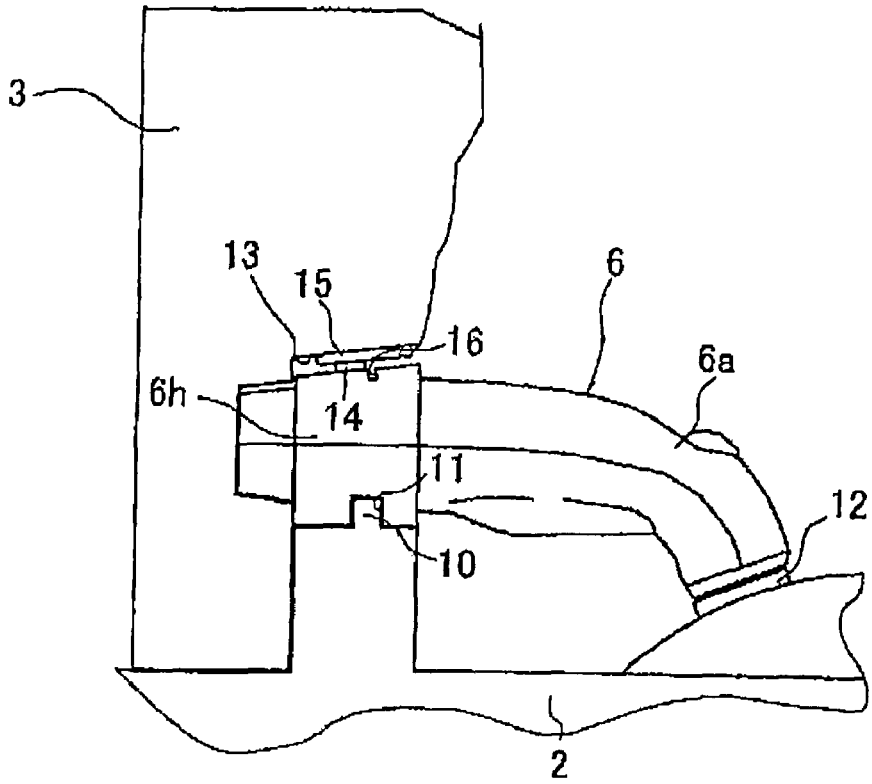
FIG. 4 is an enlarged view of a condition in which the sand core for casting is installed.
Figure 5:
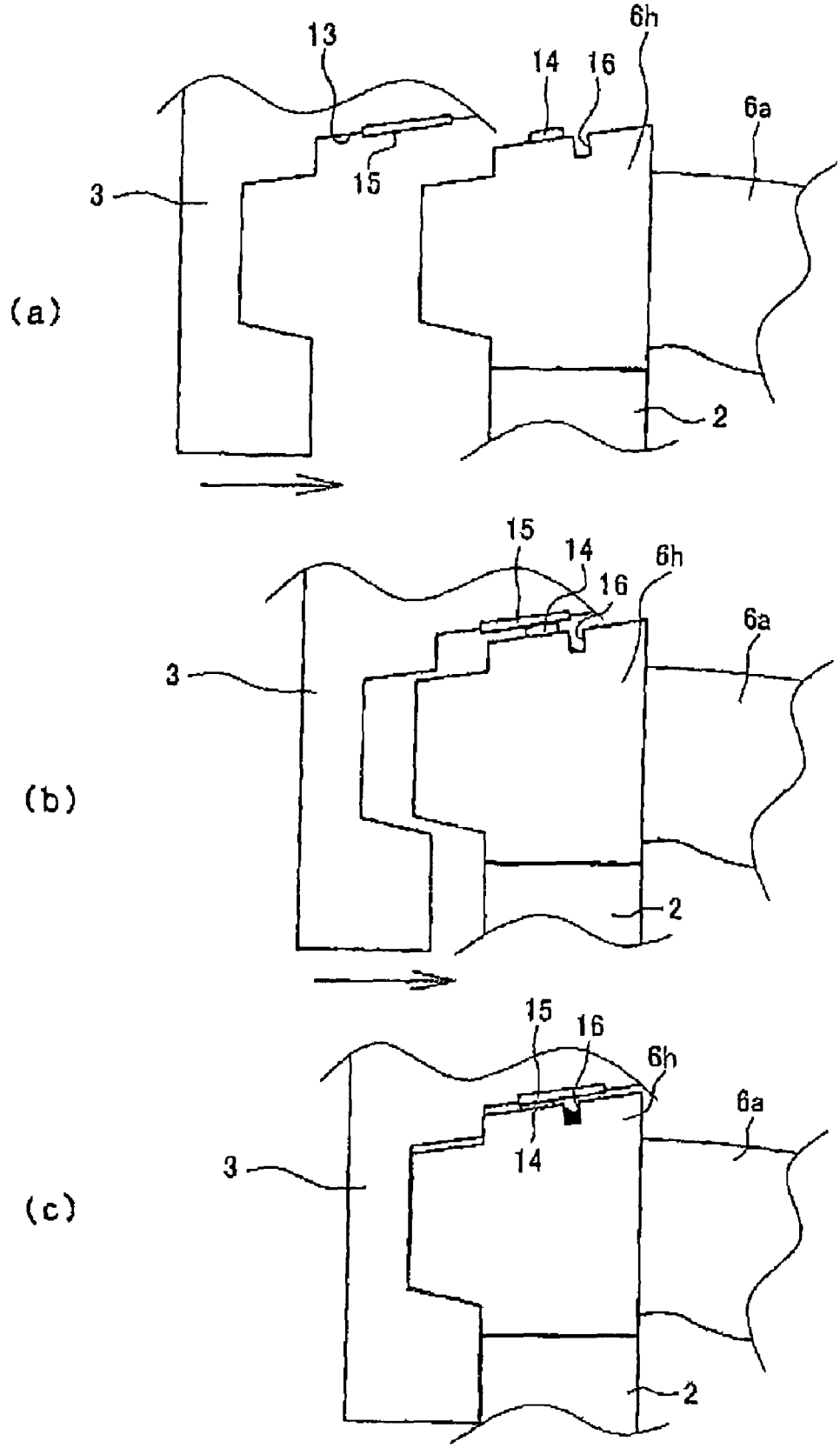
FIG. 5 is an operation view.

FIG. 1 is an explanatory view of an entire mold for casting a cylinder head to which the present sand core for casting is applied and FIG. 2 is an explanatory view showing the upper surface of the sand core for casting. FIG. 3 is an enlarged plan view of a projection and a recess provided on the upper surface of a skirting base section. FIG. 4 is an enlarged view of an installation condition of the sand core for casting and FIG. 5 is an operation view.

A technique for installing a sand core for casting according to the present invention is applied to the sand core for making an air supply and exhaust port in a mold for casting a cylinder head. According to this technique, there is no possibility that the core will be damaged or cracked even if the mold is deformed by thermal expansion. Since displacement of the core does not occur, an existing mold can still be used as is.

As shown in FIGS. 1 and 2, this mold 1 is formed to provide a cavity 5 for molding a cylinder head by right and left slide molds 3 slidably mounted on a lower mold 2 and an upper mold 4 adapted to move vertically on the slide molds 3. This cavity 5 is designed to have installed therein right and left sand cores 6 for molding an air supply and exhaust port and other cores 7, 8 for molding cavity section and like for other locations. The core according to the present invention is applied to the right and left sand cores 6 for molding the air supply and exhaust port.

As also shown in FIG. 2, this sand core 6 is long in the vertical direction of the paper surface of FIG. 1 and is provided with a skirting base section **6*h* held by a lower mold 2 and slide molds 3 and a core body section 6*a* facing the inside of the cavity 5. As shown in FIG. 4, provided along the longitudinal direction of the lower surface of the skirting base section 6*h* are at least two depressed sections 11 into which at least two positioning projections 10 provided on the lower mold 2 can be fitted. The lower mold 2 is provided with a supporting section 12 (refer to FIG. 4) on which one end of the core body 6*a*** can be mounted and supported in close contact.

On the other hand, the slide mold 3 is provided with a holding recessed section 13 into which the skirting base section **6*h* of the sand core 6 can be fitted. An opening section of the holding recessed section 13 is formed sidelong so that the skirting base section 6*h* can be fitted into the holding recessed section 13 when the slide mold 3** slidingly moves in the mold clamping direction.

The conformation, in which the slide mold 3 is provided with such a sidelong opening holding recessed section 13 and the skirting base section **6*h* is fitted into the holding recessed section 13 by clamping the slide mold 3 to hold the sand core 6, is a conventionally adopted structure. However, in such a conventional structure, there is no projection 14 on the upper surface of the skirting base section 6*h* described below and a clearance is made between the holding recessed section 13 and the skirting base section 6*h*. In this manner, when the molten metal is filled in the cavity 5, the sand core floats up by the pressure of the molten metal and a clearance is left between the supporting section 12 and the core body 6*a*. It has already been described this causes a problem in that the molten metal gets into the clearance, or the precision of shape deteriorates due to the displacement of the sand core 6**.

Thus, in the present invention, the upper surface of the skirting base section **6*h* is provided with a projection 14, while the lower surface of the holding recessed section 13 of the slide mold 3 is provided with a sliding contact section 15 which projects downwards to be brought into sliding contact with the projection 14. When the slide mold 3 is slidingly moved in the mold clamping direction, the sliding contact section 15 is brought into sliding contact with the projection 14** to scrape away part of the sand.

Further, the upper surface of the skirting base section **6*h* is provided with a recess 16 adjacent to the projection 14 to recover the sand scraped when the sliding contact section 15 is brought into sliding contact with the projection 14 within the recess 16**.

As shown in FIG. 2, these projections 14 and recesses 16 are respectively provided in two locations along the longitudinal direction of the skirting base section **6*h***.

In the present embodiment, the projection 14 is, as shown in FIG. 3, formed in a column shape of which the height is 0.5-0.8 mm and the diameter (a) is 5 mm. The recess 16 is situated on the downstream side of the mold clamping direction relative to the projection 14, wherein the length (b) along the longitudinal direction is larger than the diameter (a) of the projection 14 and is set at 8 mm, while the length (c) in the mold clamping direction is 1.5-2.0 mm and is formed in a rectangular shape, and the depth is set at 1.0-1.5 mm.

By regionally projecting the projection 14, the recess 16 adjacent to the projection 14 can be readily formed. The projection 14 can be readily formed by making it column-shaped, but the projection 14 can also be readily formed even in a prismatic or semispherical shape.

Further, by making the length (b) of the recess 16 in the longitudinal direction larger than the diameter (a) of the projection 14, the sand scraped from the projection 14 can be positively recovered within the recess 16.

It is to be noted that the shape of the recess 16 can be optional if the length (b) in the longitudinal direction is a value larger than the diameter (a) of the projection 14.

The distance between the projection 14 and the recess 16 is ideally about 0-1 mm. In the case where the distance is larger than 1 mm, there is a possibility that the scraped sand is not recovered by the recess 16, but drops into the cavity 5.

In the present embodiment, the sliding contact section 15 on the lower surface of the holding recessed section 13 of the slide mold 3 is built up to project from the lower surface of the recessed section 13 to cope with friction in the case where the sliding contact section 15 creates function with the projection 14. However, if a step, such as use of abrasion-resistant material in the sliding contact section, is taken, it is not necessary for the sliding contact section 15 to project downwards.

Operation and the like of such a mold structure will now be described referring also to FIG. 5.

The sand core 6 is mounted on the lower mold 2 of the opened mold 1. In other words, one end of the core body 6*a* is mounted on the supporting section 12, and the positioning projection 10 of the lower mold 2 is caused to fit into the depressed section 11 on the lower surface of the skirting base section 6*h* (refer to FIG. 5*a*).

Next, as shown in FIG. 5*b*, when the slide mold 3 is caused to slide in the mold clamping direction to fit the skirting base section 6*h* into the holding recessed section 13, the sliding contact section 15 is brought into sliding contact with the projection 14, wherein the scraped sand is recovered within the recess 16. The mold clamping is thus completed as shown in FIG. 5*c*.

In this condition, the skirting base section 6*h* of the sand core 6 is firmly held by the lower mold 2 and the slide mold 3, and there is no problem in which the sand core 6 floats up or shakes off even if the molten metal is poured into the cavity 5.

Further, since the sliding contact of the sliding contact section 15 with the projection 14 is not made in the direction in which the skirting base section 6*h* is depressed, damage such as cracks is not caused to the skirting case section 6*h*.

Still further, since the sand scraped from the projection 14 is recovered within the recess 16, there is no problem in which the sand drops into the cavity to be mixed into the product.

If the product is pulled out after casting is completed, the scraped sand is recovered together with the core 6 and thus, there is no problem in which the inside of the mold 1 gets dirty.

In the installation structure of the sand core as described above, only the sand core 6 is primarily different from the conventional technology and thus, an existing mold 1 can still be used as is.

It should be understood that the present invention is not limited to the embodiments described above, but may be varied in many ways. It will be apparent that modifications and variations substantially having the same configuration, operation and effect as the matters described in the appended claims of the present invention fall within the technical scope of the present invention.

For example, the number of projections 14 and recesses 16 is for reference and the molded product is not limited to a cylinder head.

EFFECTS OF THE INVENTION

By bringing a projection provided on the upper surface of a skirting base section into sliding contact with a slide mold, it is possible to prevent a core from being shaken or floated up within a mold. Since the contact between the projection and the slide mold is a sliding contact, whereby the sand of the projection is scraped away when the mold is clamped, and is made in such a direction that the pressing force is not applied to the skirting base section itself, the excessive force is not applied to the skirting base section. Further, since the scraped-away sand is recovered within a recess on the upper surface of the skirting base section adjacent to the projection, it is possible to prevent the sand from dropping into a cavity. Still further, the displaced sand can also be recovered together with recovering a sand core when the product is pulled out.

INDUSTRIAL APPLICABILITY

When a sand core is installed in a mold, the core can be firmly held. Thus, there is no problem of shaking or displacement of the core. Since the scraped-away sand can be positively recovered, it is possible to enhance the quality of a product in casting.

What is claimed is:

1. A method for installing a sand core for casting in a mold in which a slide mold slidably mounted on a lower mold is provided with a holding recessed section for holding a skirting base section of the sand core comprising the steps of:

causing the sliding mold to advance in a condition in which part of the core body is positioned and mounted on the lower mold;

bringing the lower surface of the holding recessed section of the slide mold into sliding contact with a projection provided on the upper surface of the skirting base section;

clamping the mold while recovering the sand scraped from the projection through the sliding contact within a recess formed in a position of the upper surface of the skirting base section adjacent to the projection, thereby installing the sand core in the mold.

2. The method for installing a sand core for casting in a mold according to claim 1, wherein a sliding contact section of the lower surface of the holding recessed section of the slide mold brought into sliding contact with the projection is formed to project downwards.

3. A combination of a sand core and a mold wherein said sand core for casting having a sand core body mounted on a lower mold and a skirting base section held by a holding recessed section of a slide mold, characterized in that the upper surface of the skirting base section is provided with a projection which can be brought into sliding contact with the lower surface of the holding recessed section of the slide mold when the slide mold is clamped, and the upper surface of the skirting base section adjacent to the projection is provided with a recess for recovering the sand scraped away from the projection.

4. The sand core for casting according to claim 3, wherein a plurality of projections and recesses is provided along the longitudinal direction of the skirting base section.

5. The sand core for casting according to claim 3, wherein the projection is formed in a columned, prismatic or semispheric shape.

6. The sand core for casting according to claim 3, wherein the width of the recess is larger than the maximum width of the projection.

7. The sand core for casting according to claim 4, wherein the projection is formed in a columned, prismatic or semispheric shape.

8. The sand core for casting according to claim 4, wherein the width of the recess is larger than the maximum width of the projection.

9. The sand core for casting according to claim 5, wherein the width of the recess is larger than the maximum width of the projection.

* * * * *